United States Patent [19]

Honegger

[11] Patent Number: 4,494,646

[45] Date of Patent: Jan. 22, 1985

[54] APPARATUS FOR LOOSENING AN IMBRICATED FORMATION OF PRINTED PRODUCTS OR THE LIKE

[75] Inventor: Werner Honegger, Tann-Rüti, Switzerland

[73] Assignee: Ferag Ag, Hinwil, Switzerland

[21] Appl. No.: 435,326

[22] Filed: Oct. 19, 1982

[30] Foreign Application Priority Data

Nov. 4, 1981 [CH] Switzerland ..... 7052/81

[51] Int. Cl.[3] ..... B65G 47/26

[52] U.S. Cl. ..... 198/459; 271/279; 271/69

[58] Field of Search ..... 198/459, 434; 270/58; 271/279, 294, 302, 303, 305, 69

[56] References Cited

U.S. PATENT DOCUMENTS

| | | | |
|---|---|---|---|
| 3,951,399 | 4/1976 | Reist | 270/58 |
| 3,964,598 | 6/1976 | Alsop | 198/434 |
| 4,073,118 | 2/1978 | Weber et al. | 271/279 |
| 4,145,037 | 3/1979 | Mol | 270/58 |

FOREIGN PATENT DOCUMENTS 2508194 9/1976 Fed. Rep. of Germany .

*Primary Examiner*—Joseph E. Valenza
*Assistant Examiner*—Kyle E. Shane
*Attorney, Agent, or Firm*—Werner W. Kleeman

[57] ABSTRACT

In spaced relationship from an infeed track or path for an imbricated product formation there is arranged an outfeed track or path. Between the infeed and outfeed tracks there is provided a group of movable track elements which are spaced in overlying or superimposed relationship from one another in their direction of movement. This group of track elements is guided and moved transversely with respect to the infeed and outfeed tracks or paths. Conveyor means serve to transfer the printed products from the infeed track in each case by means of one of the track elements to the outfeed track. In this way it is possible, without releasing the printed products out of the imbricated product formation and without altering the movement of the imbricated product formation or interrupting such movement, to render accessible each of the printed products for performing further processing operations thereat during the throughpass thereof at the relevant track element.

14 Claims, 7 Drawing Figures

APPARATUS FOR LOOSENING AN IMBRICATED FORMATION OF PRINTED PRODUCTS OR THE LIKE

BACKGROUND OF THE INVENTION

The present invention relates to a new and improved construction of apparatus for loosening an imbricated formation or array of printed products transversely to their surface.

The printed products which depart from a printing press usually arrive in an imbricated product formation, i.e., in such a configuration or array wherein the front or leading region of one printed product directly bears upon the rear or trailing region of a leading printed product. Such imbricated product formation also constitutes one of the most advantageous formations in order to be able to continuously transport the arriving or inbound printed products by means of appropriate conveyor devices.

If there are to be performed further automated operations at the printed products arriving in the imbricated product formation, then heretofore it was necessary to release or detach the printed products out of the imbricated product formation. This was accomplished either by initially stacking the printed products and thereafter removing single product copies out of the product stack, or, however, in that the imbricated product formation arriving from the conveyor device was accelerated to such a degree that successive printed products no longer overlapped, rather were separated by gaps or spaces from one another. In both cases there was lost the original imbricated product formation or configuration. This also meant that following the completion of the further operations which were accomplished at the individual product copies, it was necessary, as a general rule, to again reestablish the imbricated product formation which was most advantageous for the conveying of the products.

SUMMARY OF THE INVENTION

It is therefore a primary object of the present invention to provide a totally new and improved apparatus for loosening or releasing an imbricated formation of products, especially printed products.

A further and more specific object of the present invention is directed to apparatus for loosening an imbricated product formation in an extremely efficient, reliable and accurate fashion, so that desired manipulations can be carried out at individual product copies without, however, destroying the imbricated formation of the products.

A further significant object of the present invention aims at loosening an imbricated formation of products, however transversely to the surfaces of the products, wherein the products are likewise individually accessible, but there is essentially maintained the imbricated product formation.

Now in order to implement these and still further objects of the invention which will become more readily apparent as the description proceeds, the loosening apparatus of the present development is manifested by the features that, there is provided an infeed track or path and in spaced relationship therefrom an outfeed track or path. Between both of these infeed and outfeed tracks there is arranged a group of movable track elements which are moved and guided transversely to such infeed and outfeed tracks. These track elements overlie one another in spaced relationship with respect to their direction of movement. Furthermore, there are provided conveyor means in order to transfer the printed products from the infeed track by means of a respective one of the track elements to the outfeed track.

BRIEF DESCRIPTION OF THE DRAWINGS

The invention will be better understood and objects other than those set forth above, will become apparent when consideration is given to the following detailed description thereof. Such description makes reference to the annexed drawings wherein.

Figure 1:
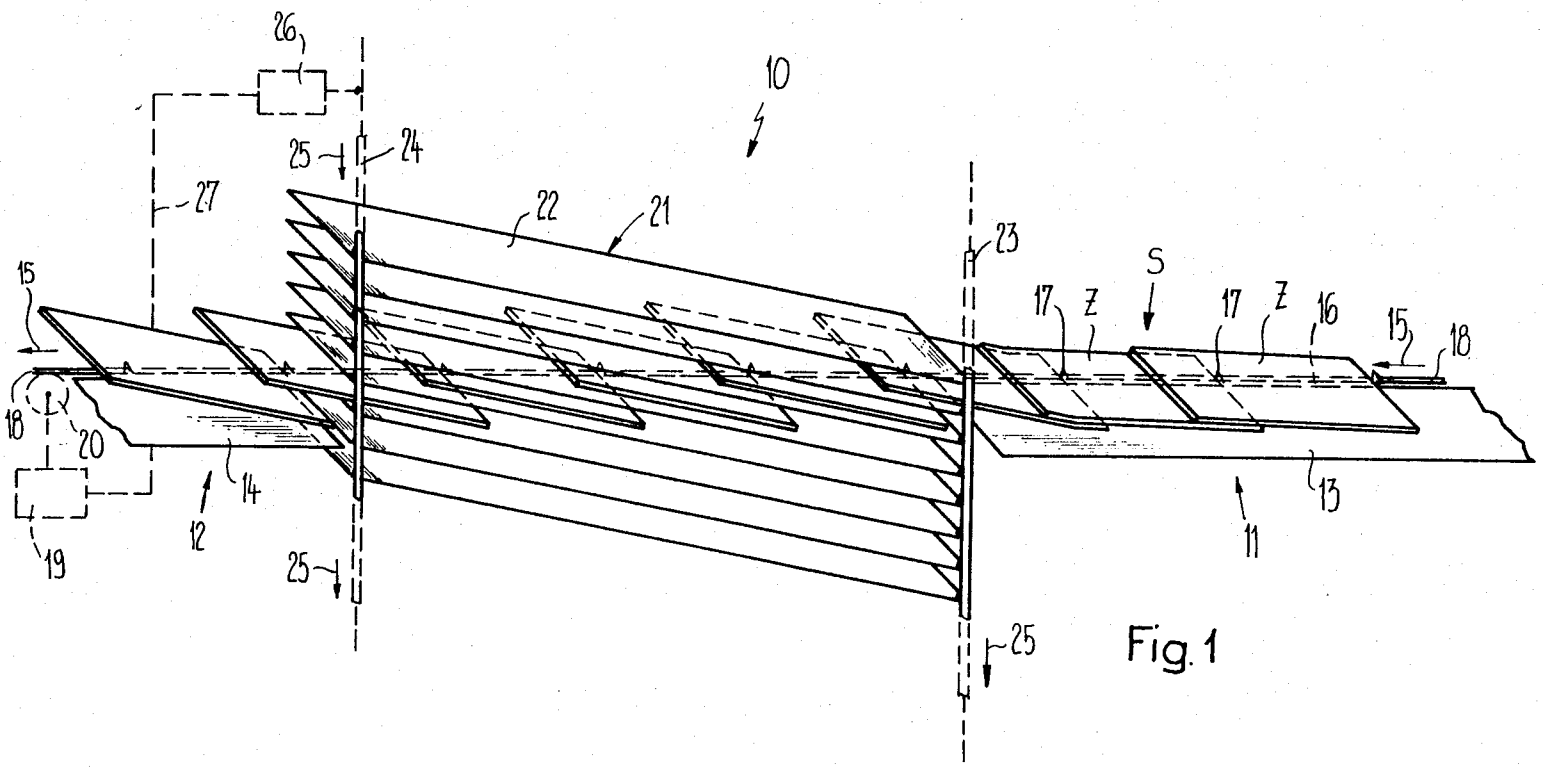
FIG. 1 is a perspective and extremely schematic view illustrating the essential components or elements of a loosening apparatus constructed according to the present invention.
Figure 2A:
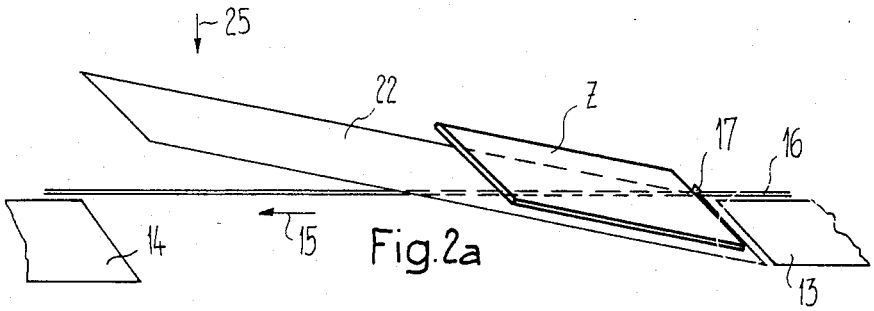
Figure 2B:
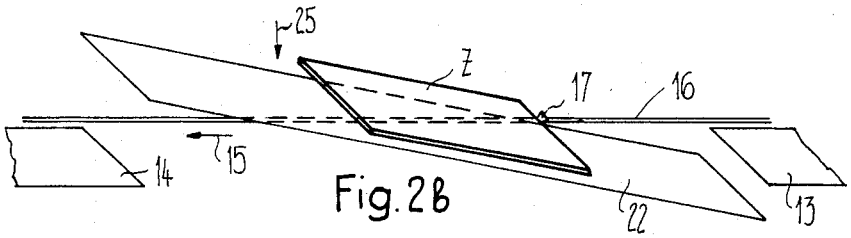
Figure 2C:
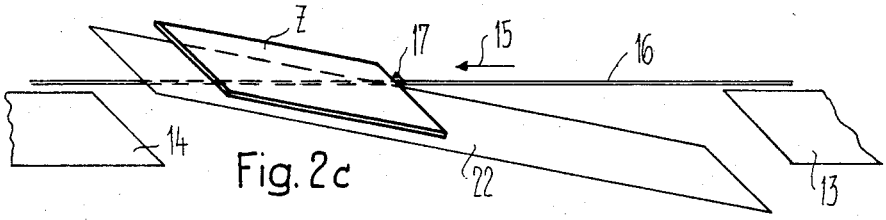
Figure 2D:
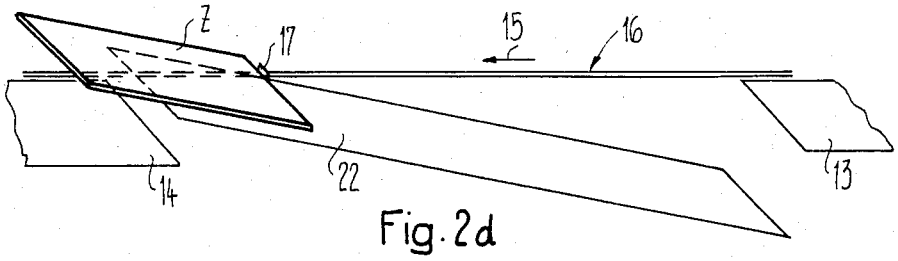
Figure 3:
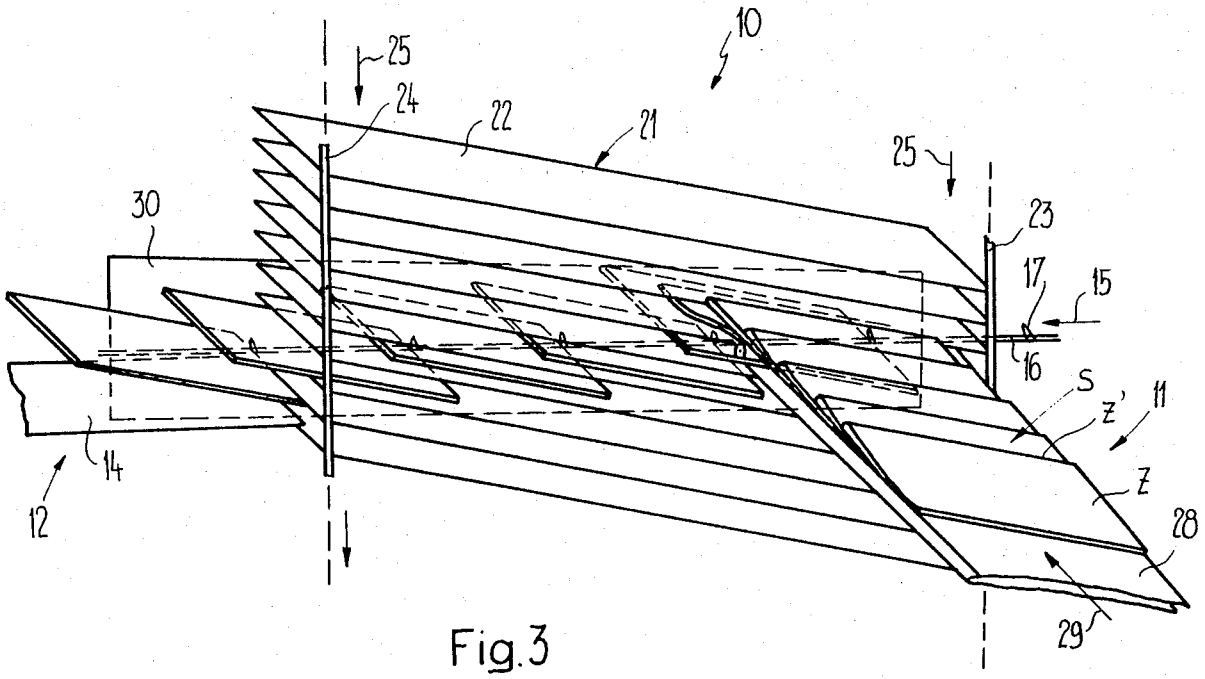
Figure 4:
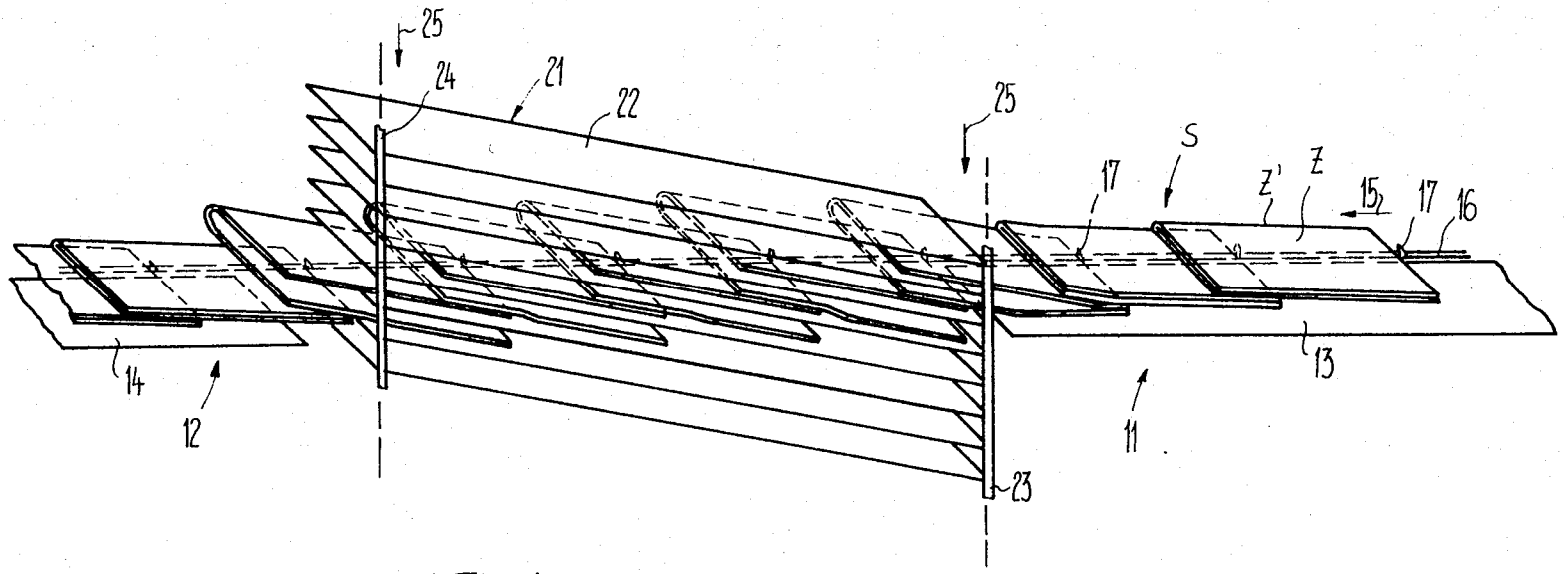

FIGS. *2a, 2b, 2c* and *2d* respectively depict the momentary taking-up of a printed product during its throughpass upon a track element, wherein in order to simplify the illustration the leading and trailing printed products, on the one hand, and the neighboring track elements, on the other hand, have been conveniently omitted from these drawings;

FIG. 3 is an illustration similar to the showing of FIG. 1 of a modified construction of apparatus; and FIG. 4 is an illustration similar to the showing of FIG. 1 of a still further modified construction of apparatus.

DETAILED DESCRIPTION OF THE PREFERRED EMODIMENTS:

Describing now the drawings, it is to be understood that for purposes of simplifying the showing of the drawings only enough of the construction of the product loosening or releasing apparatus of the present development has been depicted as needed for those skilled in the art to readily understand the underlying principles and concepts of the present development. Turning attention now to the construction of loosening apparatus 10, depicted by way of example and not limitation in FIG. 1, it will be seen that the same comprises a product infeed track or path 11 and in spaced relationship therefrom a product outfeed track or path 12. Both the product infeed or inbound track 11 and also the product outfeed or outbound track 12 each possess a respective slide table or support 13 and 14. In the exemplary emobodiment under discussion both of these slide tables or supports 13 and 14 are arranged at essentially the same elevation. Along the edges of the slide tables or supports 13 and 14, which face away from the observer of the drawing of FIG. 1, there is provided an endless conveyor device or conveyor 16 which is driven to move in the direction of the arrow 15. This endless conveyor 16 is equipped with entrainment elements 17 secured to a traction element 18 or the like at a substantially uniform spacing from one another. Each of the entrainment elements 17 engages at a trailing edge of one of the printed products Z, these printed products arriving in an imbricated product formation S. The drive of the endless conveyor 16 can be accomplished by means of a here only schematically indicated suitable drive motor 19 and a drive wheel or gear 20 driven by such drive motor 19 and which engages at the traction element 18. In the embodiment under discussion, the product infeed track or path 11 thus comprises the slide table or support 13 and a corresponding portion of the endless conveyor 16. The same holds analogously true for the product outfeed track or path 12.

Between the product infeed or inbound track 11 and the product outfeed or outbound track 12 there is provided a group or cluster 21 of essentially rectangular, planar and mutually spaced superimposed track elements 22. Each of these track elements 22 has approximately the same width as the slide tables or supports 13 and 14 and is fixedly anchored at its edge confronting the observer of the showing of FIG. 1 at two endless revolving chain-like traction or holder elements 23 and 24 or equivalent transport structure. The direction of movement of the traction elements or holder 23 and 24, and thus the group 21 of track elements 22 at the region between the infeed track 11 and the outfeed track 12 has been conveniently indicated by the arrows 25. The drive of the traction or holder elements 23 and 24 is accomplished by means of a here only schematically indicated drive motor 26 which acts upon the traction or holder element 24, and the drive velocity of this drive motor 26, as will be further explained hereinafter, is coordinated to the drive speed or velocity of the drive motor 19, which has been schematically indicated by the broken lines 27.

Each of the track elements 22 in principle extends from the region of the end of the slide table 13 up to the start of the slide table 14, and thus, bridges or spans the space prevailing therebetween. The surface of each of the track elements 22 is ascendingly arranged with respect to the path of travel of the endless conveyor 16 at the region of the group 21 of track elements 22, viewed in its conveying or transport direction, indicated by the arrow 15. The conveying velocity of the group or set 21 of track elements 22 is coordinated to the conveying velocity of the endless conveyor 16 in such a manner that, in each case, each of the track elements 22 intersects the path of travel of the endless conveyor 16 at the height of an entrainment element 17.

As will be apparent from the showing of FIG. 1, the imbricated product formation S, during passage through the group 21 of track elements 22, is loosened transversely to the surface of the individual printed products Z in the sense that the leading region of each of the printed products Z, upon travel onto one of the track elements 22, is raised from the leading printed product because of the upwardly inclined or ascending arrangement of such track element 22, without the spacing between two successive printed products (governed by the spacing of the entrainment elements 17), and viewed in the conveying direction, being appreciably altered. The imbricated formation S therefore also is maintained at the region of the group 21 of track elements 22 and, accordingly, at the region of such group 21 of track elements 22 each individual one of the printed products is individually accessible. Hence, with the exemplary embodiment of FIG. 1, it is possible during the passage of the imbricated product formation S through the group 21 of track elements 22 to, for instance, deposit upon each of the printed products Z reposing upon a related one of the track elements 22 and which has been forwardly advanced thereon, one or a number of further printed products (not shown) from the side of the observer of the drawing of FIG. 1, for instance in the sense of joining together a main product with one or more so-called pre-printed products or supplements.

Based upon the illustration of FIGS. *2a*, *2b*, *2c* and *2d* there will be further explained in greater detail the previously described mode of operation of the apparatus.

By referring specifically now to FIG. *2a*, there will be recognized a printed product Z which has just travelled completely onto one of the track elements 22 at the end of the slide table or support 13, and which printed product Z has been displaced onto the illustrated track element 22 by its related or coacting entrainment element 17. During such time as the entrainment element 17 moves further in the direction of the arrow 15 the track element 22 is lowered in the direction of the arrow 25, and the velocity of the endless conveyor 16 is coordinated to the lowering or descent velocity of the track element 22 such that the edge of the illustrated track element 22, which faces away from the observer of the drawing of FIG. *2a*, always intersects the path of the endless conveyor 16 between the infeed track 13 and the outfeed track 14 at the height of the illustrated entrainment element 17. Consequently, the entrainment element 17 remains in engagement with the trailing edge of the printed product which, in turn, is further displaced along the track element 22, as will be apparent by referring to FIGS. *2b* and *2c*. Towards the end of the throughpass of the printed product Z upon the track element 22, as indicated in FIG. *2d*, this track element 22 has moved downwardly to such an extent that its edge, confronting the slide table or support 14, has approximately reached the height of the starting region of such slide table or support 14. Hence, the printed product Z is again forwardly tilted into its essentially horizontal position, and by means of its leading region again comes to directly bear upon the trailing region of the printed product which was previously conveyed by the preceding track element onto the product outfeed or outbound track 14.

FIG. 3 again illustrates a varian construction of the apparatus in extremely schematic representation. There will be recognized the endless conveyor 16 which travels in the direction of the arrow 15 and contains the entrainment elements 17 arranged at a substantially uniform or equidistant spacing from one another in such conveying direction. Also there will be seen the outfeed or outbound track 12, constructed practically in the same manner as for the embodiment of FIG. 1, along with the slide table or support 14 which is flanked by the endless conveyor 16. Finally, there will be recognized the group 21 of track elements 22 which, just as was the case for the embodiment of FIG. 1, also move in the direction of the arrows 25. These track elements 22 are individually secured at the revolving traction elements 23 and 24.

One of the main differences between the embodiment of FIG. 3 and that of FIG. 1 concerns the product infeed or inbound track 11. This infeed track or path 11 is formed by an endless conveyor band or belt 28 or equivalent structure, the conveying direction of which, as indicated by the arrow 29, is directed approximately at right angles to the direction of extent or course of the endless conveyor 16 and the conveying plane of which is practically parallel to the surface of the track elements 22. The end of the conveying or conveyor band 28 is arranged directly neighboring the throughpassing edges of the track elements 22 which confront the observer of the drawing of FIG. 3.

As also will be readily apparent by inspecting FIG. 3, the imbricated product formation S which is delivered by means of the infeed track or path 11, is not only loosened during transfer to the track elements 22 of the group 21 of such track elements 22 in the sense that the individual products Z are raised from one another, but also is angularly deflected, without rotating the individual products Z, since the individual products Z first then come into engagement with the entrainment elements 17 when they have departed from the end of the conveyor band 28 and are displaced past the entire width of one of the track elements 22. The imbricated product formation S is maintained at the region of the group 21 of track elements 22. In order to align the imbricated formation S which is formed at the region of the group 21 of track elements 22 and transported in this case by the entrainment elements 17 of the endless conveyor 16 there can be provided at the side facing away from the observer of the drawing a guide or impact sheet metal plate 30 or equivalent structure.

With the embodiment of FIG. 3 indeed a portion or part of the length of the track elements 22 is coextensive with the infeed track or path 11, so that the printed products are not individually accessible over the entire length of the track elements 22. Since, however, the length of the track elements 22 is not subject to any principal limitations, rather at most to limitations which are governed by practical considerations, this circumstance only has an apparent drawback. Quite to the contrary, the embodiment of FIG. 3 has, in fact, the following advantage which arises by virtue of the angular deflection of the inbound imbricated product formation S. If the printed products Z which arrive from a printing press are folded, then, as has been illustrated in FIG. 3, the main fold Z' forms the leading edge upon the conveyor band or belt 28. After the angular deflection this main fold Z' of all printed products forms the edge of the imbricated formation which faces away from the observer of the drawing of FIG. 3, and which is formed at the group 21 of track elements 22 and which imbricated formation is further transported. Hence, the edge situated opposite the main fold Z' of each of the printed products, the so-called flower, is accessible at the region of the group 21 of track elements 22 from the side of the observer of FIG. 3, so that in the arrangement of FIG. 3 it is possible, for instance, to stuff by any suitable stuffing means or the like inserts into the folded printed products or to place such inserts upon such folded printed products.

The embodiment of FIG. 4 is essentially similarly constructed as the embodiment of FIG. 1. This construction of apparatus is particularly suitable for charging or loading thereof with folded printed products Z which have laterally situated main folds Z' in the imbricated product formation S. The main difference resides in a different "phase position" of the mutually synchronous movements of the endless conveyor 16 and the group 21 of the track elements 22. While taking into account the mass of the printed products Z measured in the direction 15, the velocity of the endless conveyor 16, on the one hand, and the velocity of the group 21 of track elements 22, on the other hand, are coordinated to one another in such a fashion that, in each case, the side or end region of a track element 22 which confronts the slide table 13, at the moment that the leading edge of a printed product has reached the end edge of the slide table or support 13, has not yet completely reached the height of this end edge, rather is situated somewhat higher by an amount corresponding to approximately one-half of the thickness of a printed product. In this case the edge confronting the slide table or support 13 of each of the track elements 22 acts upon the momentarily arriving printed product in the manner of an opening sword or divider element in the sense that only the upper half of the printed product Z comes to lie upon the related track element 22, whereas the lower half of the same printed product bears upon the preceding or immediately leading track element or upon the upper half of the printed product which has been forwardly advanced along such track element. Consequently, the printed products, during passage through the group 21 of track elements 22, are opened and the thus formed opening gap is available in order to be able to insert, from the side of the observer of the drawing, for instance an insert into and not upon the printed product.

Of course, also the embodiment of FIG. 4 can be operated with an imbricated product formation without the described different "phase position" of the movements of the endless conveyor 16 and the group 21 of track elements 22, in which the folded printed products have the laterally situated main fold Z'. However, in that case the entire printed product always comes to bear upon one of the track elements 22.

The infeed track or path 11 and the outfeed track or path 12 need not be located at the same height. For instance, the product outfeed or outbound track 12 can be situated lower than the product infeed or inbound track 11. In this case the path of the endless conveyor 16 at the region of the group 21 of the track elements 22 must, for instance, overcome the elevational difference between the infeed track 11 and the outfeed track 12. This can be accomplished, for instance, by appropriately deflecting or turning the traction element 18 or by subdividing the endless conveyor into an infeed portion, into a "group" portion, and an outfeed portion. In this case the surfaces of the track elements 22 also can extend essentially parallel to the slide tables or supports 13 and 14. Also in such case the surface of the track elements remains ascending at the path of the conveyor 16, viewed in its direction of movement, which sinks or drops at the region of the group 21 of track elements 22.

Also the track elements 22 can be arranged at revolvingly driven circular rims or hoops, and can extend therefrom radially inwardly or outwardly. To the extent that in such design an endless conveyor is guided along the now ray-like group of track elements, its track or path must be shifted to the side of the track elements which faces away from the attachment location of the track elements at the circular rims or the like. Additionally, in this case the surfaces of the track elements advantageously should not be constructed to be flat or planar, rather twisted.

According to a further exemplary embodiment, it is possible to construct each of the track elements itself so as to be effective as a conveyor device, for instance to design such as a conveyor belt or to provide such with such a conveyor belt. This conveyor belt then only would be advantageously driven when the track element is located at the region between the infeed track or path and the outfeed track or path.

While there are shown and described present preferred embodiments of the invention, it is to be distinctly understood that the invention is not limited thereto, but may be otherwise variously embodied and practiced within the scope of the following claims. Accordingly, what I claim is:

1. An apparatus for loosening an imbricated formation of products, especially printed products, transversely with respect to their surface, comprising:

a product infeed track for infeeding the imbricated formation;

a product outfeed track arranged in spaced relationship from said product infeed track;

a group of mutually spaced overlying track elements arranged between said infeed track and said outfeed track;

means for moving and guiding said group of track elements substantially transversely with respect to said product infeed and outfeed tracks;

said overlying track elements being spaced from one another in the direction of movement of said track elements; and conveyor means cooperating with said track elements in order to feed single products from the imbricated formation infed by means of said product infeed track to respective ones of the track elements and to displace the single products along said respective ones of said track elements to the product outfeed track.

2. The apparatus as defined in claim 1, wherein:

said conveyor means comprises an endless conveyor; and said endless conveyor being provided with entrainment elements, each of which acts upon a related one of the single products at least during the displacement of the single products along said respective ones of said track elements.

3. An apparatus for loosening an imbricated formation of products, especially printed products, transversely with respect to their surface, comprising:

a product infeed track;

a product outfeed track arranged in spaced relationship from said product infeed track;

a group of mutually spaced overlying track elements arranged between said infeed track and said outfeed track;

means for moving and guiding said group of track elements substantially transversely with respect to said product infeed and outfeed tracks;

said overlying track elements being spaced from one another in the direction of movement of said track elements;

conveyor means for transferring the printed products from the product infeed track by means of a respective one of the track elements to the product outfeed track;

said conveyor means comprising an endless conveyor;

said endless conveyor being provided with entrainment elements, each of which is intended to coact with one of the printed products;

each said product infeed track and said product outfeed track comprising a respective slide table; and said endless conveyor being guided substantially along said slide tables.

4. An apparatus for loosening an imbricated formation of products, especially printed products, transversely with respect to their surface, comprising:

a product infeed track;

a product outfeed track arranged in spaced relationship from said product infeed track;

a group of mutually spaced overlying track elements arranged between said infeed track and said outfeed track;

means for moving and guiding said group of track elements substantially transversely with respect to said product infeed and outfeed tracks;

said overlying track elements being spaced from one another in the direction of movement of said track elements;

conveyor means for transferring the printed products from the product infeed track by means of a respective one of the track elements to the product outfeed track;

said conveyor means comprising an endless conveyor;

said endless conveyor being provided with entrainment elements, each of which is intended to coact with one of the printed products;

said track elements have surfaces which, with respect to a predetermined path of movement of the endless conveyor extending along the group of track elements, viewed at the region of such group of track elements ascend in the conveying direction.

5. The apparatus as defined in claim 4, wherein:

said track elements of said group are arranged at a fixed spacing from one another and essentially in parallelism with respect to one another; and said track elements being moved parallel to themselves from the top towards the bottom at the region between the product infeed track and the product outfeed track.

6. The apparatus as defined in claim 4, further including:

endless revolving holder elements; and said track elements being secured at a side thereof facing away from the endless conveyor at said endless revolving holder elements.

7. The apparatus as defined in claim 6, wherein:

said holder elements comprise substantially chain-like holder elements.

8. The apparatus as defined in claim 6, wherein:

said holder elements comprise circularly revolving rims at which there are secured in a substantially ray-like configuration said track elements so as to extend in a predetermined direction.

9. The apparatus as defined in claim 8, wherein:

said predetermined direction of extent of said track elements is towards the inside.

10. The apparatus as defined in claim 8, wherein:

said predetermined direction of extent of said track elements is towards the outside.

11. The apparatus as defined in claim 2, wherein:

said product infeed track is provided with additional endless conveyor means; and said additional endless conveyor means extending transversely to the endless conveyor provided with said entrainment elements and which is guided along the group of said track elements.

12. The apparatus as defined in claim 4, wherein:

the spacing of the entrainment elements from one another and the velocity of the endless conveyor are coordinated in such a manner to the spacing of the track elements from one another that at an intersection point of the endless conveyor with in each case one of the track elements there always is present an entrainment element.

13. The apparatus as defined in claim 4, wherein:

the spacing of the entrainment elements from one another and the velocity of the endless conveyor are coordinated in such a manner to the velocity of movement of the group of track elements that at an intersection point of the endless conveyor with in each case one of the track elements there always is present an entrainment element.

14. The apparatus as defined in claim 7, wherein:

said track elements are constituted by essentially rectangular and planar sheet metal guide elements.

* * * * *